US010161216B2

(12) United States Patent
Samuelson

(10) Patent No.: US 10,161,216 B2
(45) Date of Patent: Dec. 25, 2018

(54) WELL ABANDONMENT SYSTEM AND METHOD

(71) Applicant: CONOCOPHILLIPS COMPANY, Houston, TX (US)

(72) Inventor: David John Samuelson, Calgary (CA)

(73) Assignee: ConocoPhillips Company, Houston, TX (US)

( * ) Notice: Subject to any disclaimer, the term of this patent is extended or adjusted under 35 U.S.C. 154(b) by 304 days.

(21) Appl. No.: 15/018,915

(22) Filed: Feb. 9, 2016

(65) Prior Publication Data

US 2016/0230490 A1 Aug. 11, 2016

Related U.S. Application Data

(60) Provisional application No. 62/113,645, filed on Feb. 9, 2015.

(51) Int. Cl.
*E21B 33/13* (2006.01)

(52) U.S. Cl.
CPC ..... *E21B 33/13* (2013.01)

(58) Field of Classification Search
CPC ..... E21B 33/13; E21B 34/00; E21B 19/00
See application file for complete search history.

(56) References Cited

U.S. PATENT DOCUMENTS

2009/0211766 A1* 8/2009 Cuthill ..... E21B 33/02 166/378
2013/0042761 A1* 2/2013 Ring, Sr. ..... B04C 5/085 95/271

* cited by examiner

*Primary Examiner* — Caroline N Butcher
(74) *Attorney, Agent, or Firm* — Boulware & Valoir

(57) ABSTRACT

A system and method for well abandonment, comprising installing a first steel plate comprising a hole having a pipe section attached above the hole, wherein a coupler may be installed to house a stopper which is then positioned below the surface casing having a second steel plate, the capping plate, affixed to the top of the surface casing. The stopper system then acts to prevent the exchange of wellbore fluid into the environment while allowing for proper venting of casing strings by pressure actuating the stopper system against the cap. The coupler further provides for attachment of various gas sampling or other monitoring equipment in for purposes of detection of leaks or other analytical objectives.

15 Claims, 6 Drawing Sheets

WELL ABANDONMENT SYSTEM AND METHOD

CROSS-REFERENCE TO RELATED APPLICATIONS

This application is a non-provisional application which claims benefit under 35 USC § 119(e) to U.S. provisional application Ser. No. 62/113,645 filed Feb. 9, 2015, entitled "Well Abandonment System and Method," which is hereby incorporated by reference.

STATEMENT REGARDING FEDERALLY SPONSORED RESEARCH

None.

FIELD OF THE INVENTION

The present disclosure relates in general to the field of hydrocarbon and/or petroleum well abandonment. In particular, the present disclosure relates to a system and method for a surface abandonment of a hydrocarbon well in which the casing is vented at the surface.

BACKGROUND OF THE INVENTION

Hydrocarbon wells that have reached their end of life, or which are not feasible for production purposes are typically abandoned. Well abandonment is typically subject to legal and regulatory frameworks for ensuring that wellbore contamination does not occur—either from wellbore fluids leaking into the environment, or from the influx of groundwater into casing strings. Improperly abandoned wells have significant impacts on the surrounding environment, and various regulatory bodies have requirements for the approach taken to properly abandon the wells.

Among the requirements for well abandonment often includes multiple steps that may include: (i) notifying regulatory agencies and landowners (ii) testing the well for likelihood of contamination; (iii) developing an abandonment plan taking into consideration any wellbore issues; (iv) cleaning the internal surface of the well; (v) repairing damaged or other permeable aspects of the well; and (vi) preventing corrosion. Another requirement may include cutting and capping the well below ground level and installing a vented cap.

Due to ongoing testing requirements for abandoned wells, problems arise in the continued monitoring of gas flows. Further, regulators are not often prescriptive in such requirements. It is therefore a critical need to efficiently ensure the working environment of the underground facility is effectively monitored and controlled for hazardous gases and events.

BRIEF SUMMARY OF THE DISCLOSURE

The present disclosure addresses limitations in the art by providing a system and method for a vented cap to a casing string for surface well abandonment. The present disclosure calls for the installation of a stopper that allows casing gases to vent to atmosphere when sufficient pressure builds inside the casing or annulus, thus obviating the need for valves or other componentry. Moreover, the system of the present invention prevents the exchange of wellbore fluid into the environment. For instance, many wells have a film of liquid hydrocarbons on the casing walls, which fluid, over time, could otherwise rise to the surface and leak out into the environment.

It is another object of the present disclosure to prevent the influx of groundwater into the casing strings. The exchange of wellbore/groundwater fluids into the casing will introduce dissolved oxygen in the casing that will induce internal corrosion of the casing.

It is another object of the present disclosure to address, if the well begins to leak, the operator has the ability to obtain a gas sample for isotope or other analysis. The coupler of the present disclosure is installed to protect the threads from corrosion so they can be used to install a valve or to obtain a gas sample for isotope analysis.

It is another object of the present disclosure to retain the ability to top fill the well.

Moreover, the system of the present invention may prevent a minimal gas flow which meets the regulatory requirements for surface abandonments. This will allow for abandonment of wells that have an annular gas flow that meets the regulatory abandonment requirements but will not meet the reclamation requirements.

It is therefore an object of the present disclosure to provide a system and method for well abandonment, comprising installing a first steel plate comprising a hole having a pipe section attached above the hole, wherein a coupler may be installed to house a stopper which is then positioned below the surface casing having a second steel plate, the capping plate, affixed to the top of the surface casing.

It is another object of the present disclosure to have the first plate located at a sufficient depth to allow the stopper to eject partially from the coupler in response to gas pressure, wherein the stopper rests against the plate of the cap of the surface casing. The present disclosure provides a solution to typical vented well abandonment caps as it further prevents the exchange of wellbore fluids into the environment. Further the system and method of the present disclosure prevents the influx of groundwater into the casing strings. Such exchanges of well bore and/or groundwater fluids will introduce oxygen in the casing which induces internal corrosion of the casing. These and other features of the present invention will become readily apparent to one of skill in the relevant art upon further review of the following specification and drawings.

In general, in one aspect, the invention features a method of capping a hydrocarbon well that includes cutting a well casing string, wherein an internal production casing of the well casing string is cut lower than the external surface casing of the well casing string. A first plate, which may be a steel plate, is inserted having a hole formed in the plate. A threaded pipe section is attached to the plate over the hole. The pipe section may be welded over the hole cut into the plate. In another aspect, the pipe section may be threaded, and a coupler is attached to the pipe section utilizing the threaded portion of the pipe section. A stopper is then positioned within the coupler to act as a sealing mechanism over the hole in the plate.

In another aspect of the invention, the plate is then welded to the inside of the surface casing where the stopper, at a resting position, rests below the top surface of the capped surface casing. A surface cap is then welded to the top of the surface casing to provide a vented seal. The welding may be a tack-welding to allow for ventilation between the welds. The stopper is then able to be pushed out, or partially ejected, from the coupler in response to gas pressure within the casing. When pushed out, the stopper positions against the above surface cap. When pressure is relieved, the stopper repositions in the lower position as a seal.

Implementations of the invention can include one or more of the following features. The hole in the first plate which is welded to the inside of the surface casing may be between 10 and 25 mm. The stopper utilized may be rubber, plastic, or other polymer material providing a flexible sealing object such as a #6.5 rubber stopper for a 25 mm diameter pipe section typically 25-50 mm in length, or similar appropriately sized stopper for differing pipe section sizes.

In general, in another aspect, the invention features a well abandonment system having a first plate having a hole formed, wherein a threaded pipe section is attached on the top portion of the first plate, a coupler attached to the threaded portion of the pipe section, a stopper placed within said coupler, said stopper positioned to be actuated to allow the escape of gases from beneath the first plate through the hole; and a second plate comprising a cap welded to the top of the surface casing of an abandoned well, wherein the stopper positioned onto the coupler attached to the first plate is actuated against the lower surface of the section plate when actuated fully to allow the escape of gases from the well.

The well abandonment system contains the first plate located at a depth operable to allow the stopper to eject partially from the coupler in response to gas pressure, wherein the stopper rests against the plate of the cap of the surface casing.

Implementations of the invention can include one or more of the following features: the hole in the first plate may have a diameter between 10 and 25 mm. In one aspect, the hole in the first plate has a diameter of at most 25 mm. The threaded pipe may be between 20 and 50 mm in length. In one aspect, the well abandonment system has 25 mm threaded pipe.

BRIEF DESCRIPTION OF THE DRAWINGS

The foregoing and other objects, features, and advantages of the disclosure will be apparent from the following description of embodiments as illustrated in the accompanying drawings, in which reference characters refer to the same parts throughout the various views. The drawings are not necessarily to scale, emphasis instead being placed upon illustrating principles of the disclosure.

DETAILED DESCRIPTION OF THE DISCLOSURE

Figure 1:
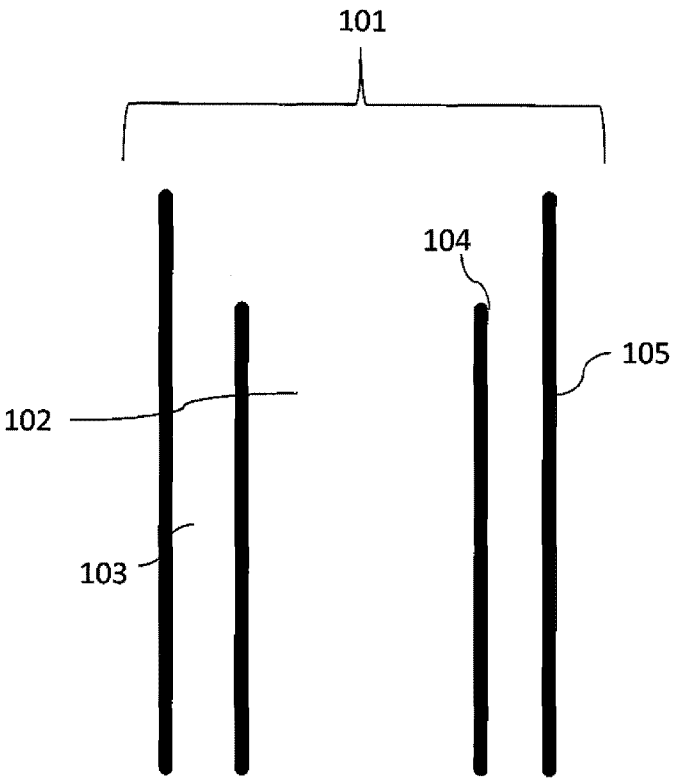
FIG. 1 depicts a cross-sectional view of a well casing having a production casing within the surface casing in which the cut well casing has the production casing cut at a level below the surface casing.

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

While the making and using of various embodiments of the present disclosure are discussed in detail below, it should be appreciated that the present disclosure provides many applicable inventive concepts that can be embodied in a wide variety of specific contexts. The specific embodiments discussed herein are merely illustrative of specific ways to make and use the disclosure and do not delimit the scope of the disclosure.

All publications and patent applications mentioned in the specification are indicative of the level of skill of those skilled in the art to which this disclosure pertains. All publications and patent applications are herein incorporated by reference to the same extent as if each individual publication or patent application was specifically and individually indicated to be incorporated by reference.

The present disclosure will now be described more fully hereinafter with reference to the accompanying figures and drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

In the present disclosure, casing refers to hollow steel piping to line the inside of a drilled borehole, utilized primarily for isolating the surrounding formations, such as aquifers and other groundwater, from the drilling and production operations which occur. The full length casing is referred to as a casing string. The casing string will typically include a surface string, a production string and may also include an intermediate casing string(s). The surface casing is the external casing that acts as a barrier to the formation environment and runs from the surface to just above the bottom of the hole. These strings are often set in the well and cemented in accordance with applicable standards and requirements from regulatory or governing bodies. Often the casing is cemented into place by utilizing a cement sheath around the casing strings. After the surface casing is set, the production/intermediate casing is typically set within the surface casing and down to the targeted producing formation. Production/intermediate casing may also be set in cement similar to the surface casing.

For the purposes of the present disclosure, the term capping refers to the process of providing a top seal of a well string to properly abandon the well. Capping involves, as regulated in most jurisdictions, excavating the land below the surface, ranging from 0.5 meters to 5 meters, cutting the production and surface casings and covering the well casings with a plate, such as a steel plate, which may be welded in a continuous weld, or tack welding process. Welding is considered a fabrication process that joins materials by causing coalescence, typically by melting the workpieces and adding a filler material to act as a joint using a multitude of methods known in the art. Tack welding is a specific short, intermittence series of welds spaced some distance apart, leaving gaps in the joint in between the welded portions. For the purposes of the present disclosure tack welding provides for venting when utilized for the attachment of caps or seals.

Figure 2:
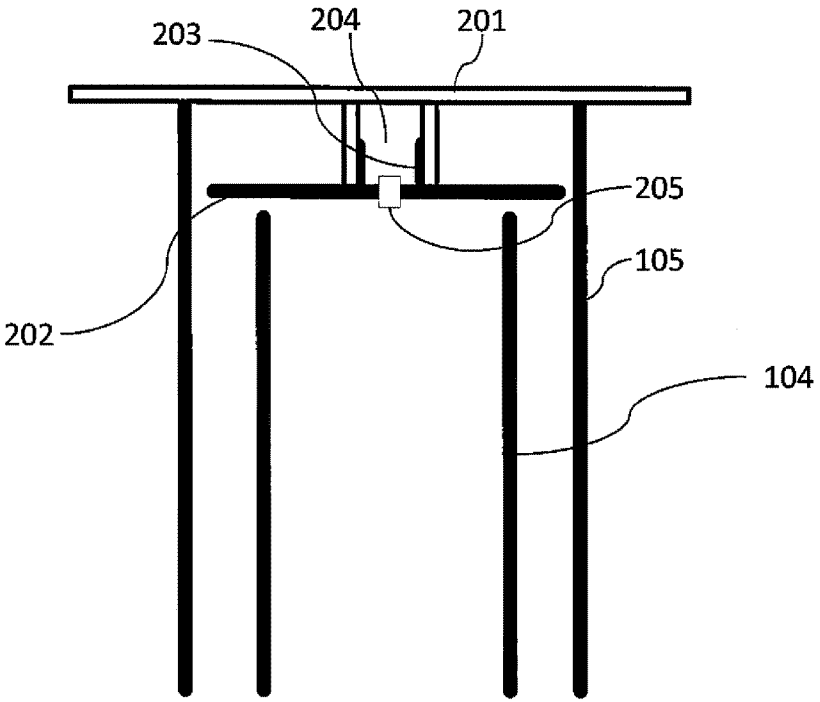
FIG. 2 depicts a cross-sectional view of a well casing and optional installation tool for inserting a steel plate to be welded above the production casing and inside the surface casing.

Turning to FIGS. 1-5, illustrative embodiments of a well abandonment system of the present disclosure are provided. In FIG. 1, in one embodiment of the present disclosure, a hydrocarbon casing string 101 is cut with the production casing 104 lower than the top of the surface casing 105. Turning to FIG. 2, a first steel plate 202 with its outer diameter (OD) slightly less than the inner diameter (ID) of the surface casing 105 is fully welded inside the surface casing 105. In one embodiment of the present disclosure, this first steel plate 202 has a hole 205 cut in the first plate. This hole 205 may be 25 mm in diameter or less. Affixed over the hole 205 by welding, a short coupler from about 25 mm to about 50 mm in length of 25 mm diameter pipe 203 is positioned over the hole 205 in the first steel plate 202. The section of pipe 203 may be larger in diameter relative to the size of the hole 205. The section of pipe 203 welded over the hole 205 may be threaded at the top.

In another embodiment, an optional installation tool 201 is then attached to the first steel plate 202 by threading onto the pipe section 203 attached to the first steel plate 202. The installation tool 201 allows the first steel plate 202 to be hung at the proper distance under the top cut level of the surface casing 105 and over the cut section of the production casing 104. The installation tool 201 suspends the first steel plate 202, which may then be welded to the ID of the surface casing 105. Once the first steel plate 202 is welded to the ID of the surface casing 105, the installation tool 201 may be removed.

In another embodiment of the present disclosure, a rod may be tack welded onto the first steel plate 202, wherein the first steel plate is lowered to the appropriate depth in the surface casing 105 with use of the tack welded rod. The first steel plate 202 is then fully welded inside the surface casing 105 at a depth that allows enough clearance for the stopper 304 to vent pressure but not eject from the coupler 203. The tack welded rod may then be removed from the plate.

Figure 3:
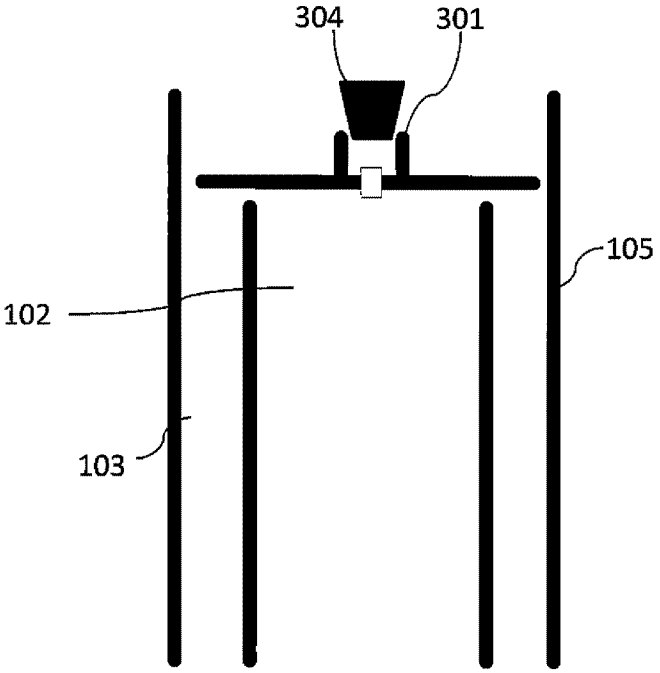
FIG. 3 depicts a cross-sectional view of a well casing having an insertion of a stopper into the coupler attached to a threaded pipe.

In another embodiment of the present disclosure, as shown in FIG. 3, upon removing the installation tool 201, a coupler 301 is installed onto the threaded pipe section attached to the first steel plate. The coupler 301 may be a 1-inch, schedule 40 coupler fully welded over the hole 205, although the coupler 301 may vary in size due to regulatory requirements or size of the hole 205 and pipe section 203 of the first steel plate due to desired ranges of venting capacity. Because the threads of coupler 301 are protected by the rubber stopper 304 corrosion is prevented for purposes of utilizing the threads for subsequent removal and monitoring purposes, such as gas detection and isotope analysis.

Figure 4:
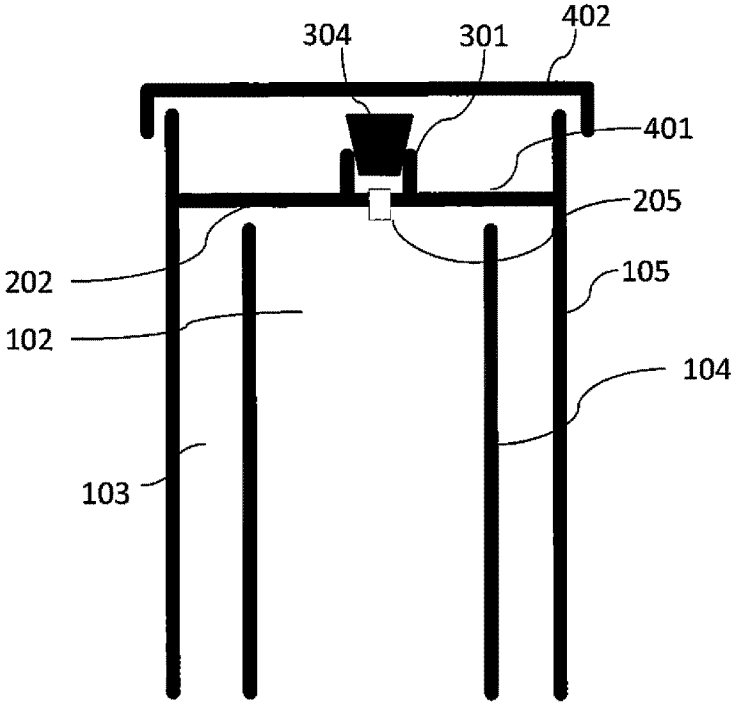
FIG. 4 depicts a cross-sectional view of an abandoned well casing having the first plate with a stopper assembly engaged, as well as a cap of the surface casing.
Figure 5:
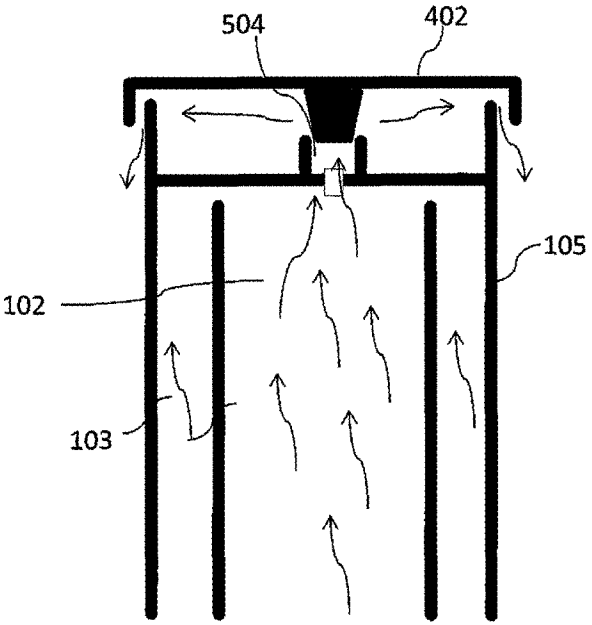
FIG. 5 depicts a cross-sectional view of an abandoned well casing with venting occurring as pressure causes the stopper to eject against the surface casing cap, allowing gas to be released.

Turning to FIG. 4, the assembly 401 comprising the first plate 202 which has a hole 205 perforating the plate and a coupler 301 attached to the pipe section 203 over the hole 205 represents the assembly to be welded inside the surface casing 105 and over the production casing 104 which was cut at a lower depth than the surface casing 105. In one embodiment the assembly 401 may include an optional installation tool 402. In one embodiment the distance from the location of the assembly comprising the first plate and the top of the cut surface casing 105 is determined to allow for a stopper 304 to be placed into the coupler. The stopper 304 may be a rubber stopper or other stopper made of plastic, synthetic rubber, and the like. The stopper 304 may be of varying shapes and sizes, including tapered shaping able to provide a secure watertight seal. The first steel plate assembly 401 may be positioned with clearance above the assembly to allow the stopper 304, due to gas pressure within the well 102, 103, to be pushed upward to a position where the gas may pass through the first steel plate through the coupler and opened stopper 504 as shown in FIG. 5. Upon experiencing the pressure relief, the stopper 304 repositions downward to close and seal the coupler. In another embodiment, a spring or tensioner may be applied above the stopper to allow force to be exerted downward to re-position the stopper.

In one embodiment, the assembly comprising the first plate, the hole, and coupler installed onto the pipe section welded over the hole, is welded inside the surface casing 105 at a depth where the top of a rubber stopper, such as a #6.5 rubber stopper, will be just below the top of the surface casing 105. Once the first steel plate comprising the coupler and stopper is installed, a second steel plate is then attached to the surface casing 105. The second steel plate is the cap of the surface casing 105, and attached over the top of the cut surface casing 105. The second steel plate comprises a capping component and configuration, having a top portion comprising the steel plate, and cylindrical casing having an ID larger than the OD of the surface casing 105 welded to the steel plate. A steel cap is then tack welded over the surface casing 105, wherein the tack welding provides for venting capability. Once fully installed the excavated portion may be backfilled to finalize the capping, or abandonment process.

The addition of the stopper configuration to surface abandonments will prevent the exchange of wellbore fluid into the environment while still meeting the intent of the regulations by not allowing for pressure to build-up inside the casing strings. Surface abandonment of wells as described herein provides the several benefits and additional features. In one embodiment, the system prevents the exchange of wellbore fluid into the environment. It is common with many wells to have a film of liquid hydrocarbons on the casing walls. Over time this fluid will rise to the surface and leak into the environment. The present system will prevent such occurrence, and will prevent the influx of groundwater into the casing strings. Further, the exchange of wellbore/groundwater fluids into the casing will introduce dissolved oxygen in the casing which will induce internal corrosion of the casing. The introduction of the stopper configuration of the first steel plate in the present disclosure will allow for such gases to be emitted.

In another embodiment of the present disclosure, if the well begins to leak, operators will have the ability to obtain a gas sample for isotope analysis. The coupler is installed in order to protect the threads from corrosion so they can be used to install valves or to obtain gas samples for isotope analysis. In another embodiment, the well may be top filled with water prior to extending the casing strings back to the surface.

In another embodiment of the present disclosure, an illustrative process is as follows: prior to initiation of the abandonment process of the present invention, wellhead outlets and surface casing vents are checked for pressure, H2S, LEL, fluid and/or flammable liquids. The wellhead is excavated to at least one (1) meter down below ground level around the conductor barrel. The top of the conductor barrel cut and removed before removing exposed cement. Windows are cut in the surface casing. Reach in through the window and cut off the production casing. Finish cutting the surface casing and remove the cut-off stub and wellhead. Excavate around the wellhead to the required depth (which may generally be 2 meters). Cut and remove conductor barrel and remove exposed cement from the inside. Cut slots for lifting chains or slings and perform a final cut on surface casing. Where possible, the surface casing should be cut-off at least 2 meters below the final grade. Perform the final cut on the production casing. Cut slots near top of production casing for lifting chains or slings and attach lifting chains or slings to the top of the production casing. The top of the production casing is then lifted with a picker or excavator boom as the final cuts are made to release the top of the production casing. The production casing must be cut at least 10 cm below the surface casing to allow sufficient room for installation of the plate in section. The plug assembly to be used comprises: a steel plate with its OD slightly less than the ID of the surface casing, a 25 mm coupler, and a size 6.5 rubber stopper. The cap assembly to be used comprises a steel plate to be partially welded (i.e. vented) to the surface casing.

Figure 6A:
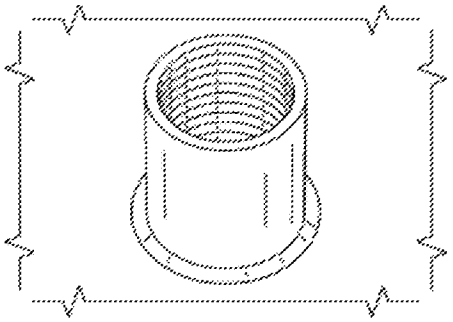
FIG. 6A-D depict various assembly stages of the steel plate (FIG. 6A), having the coupler welded (FIG. 6B), installed above the production casing (FIG. 6C), and insertion of the rubber stopper (FIG. 6D).
Figure 6B:
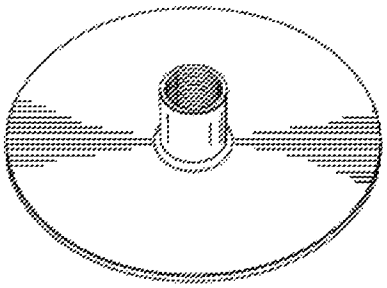
Figure 6C:
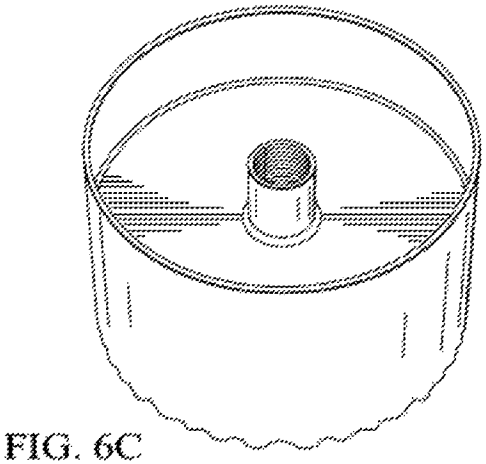
Figure 6D:
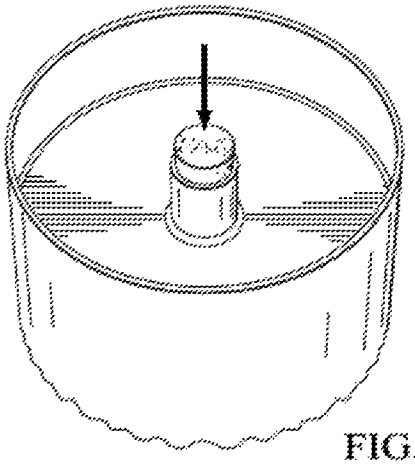

To install the plug and cap assemblies, cut a hole less than 25 mm diameter in a steel plate. The steel plate must fit into the ID of the surface casing. Fully weld a 25 mm coupler over the hole in the steel plate (see FIGS. 6A and 6B). Place the plugging assembly inside the surface casing and fully weld in place. Remove any cement or debris which may be hindering sufficient lowering of the plugging assembly into the surface casing. The depth of the plate should be 7 cm below the surface casing top to ensure that there is clearance between the stopper and the cap assembly. Tack-weld a rod to the plate to lower it inside the surface casing and hold it in place. Fully weld the plate to the surface casing and remove the rod used for installation (see FIG. 6C). Next, insert a rubber stopper into the coupler (see FIG. 6D). The stopper should not be hammered or twisted in place.

Following assembly and installation of the plug and cap, weld the cap assembly over top of the surface casing. The cap serves as a debris cover and it cannot rest on the rubber stopper and must be 'vented'.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

What is claimed is:

1. A method of capping a hydrocarbon well consisting essentially of:

(a) cutting a well casing string, wherein an internal production casing of the well casing string is cut lower than an external surface casing of the well casing string;

(b) inserting a first plate under a cut level of said surface casing and over a cut level of said production casing, said first plate having a hole formed in said first plate;

(c) welding a threaded pipe section over said hole;

(d) installing a coupler section onto said pipe section;

(e) inserting a stopper into said coupler;

(f) welding said first plate to the surface casing to cover the production casing (g) welding a cap to a top of the surface casing to provide a vented seal, such that said cap rests above said stopper at a distance to only allow partial ejection of said stopper.

2. The method of claim 1, wherein the hole in the first plate has a diameter between 10 and 25 mm.

3. The method of claim 1, wherein the threaded pipe is between 20 and 50 mm pipe in length.

4. The method of claim 1, wherein the threaded pipe is 25 mm diameter pipe.

5. The method of claim 1, wherein the stopper comprises a rubber stopper.

6. The method of claim 5, wherein the stopper comprises a #6.5 rubber stopper.

7. The method of claim 1, wherein the first plate is located at a position to allow the stopper to eject partially from the coupler in response to gas pressure, wherein the stopper rests against the plate of the cap of the surface casing and cannot be ejected.

8. A well abandonment system, consisting of:

(a) a first plate having a hole formed therein, wherein a threaded pipe section is attached on a top portion of the first plate over said hole;

(b) a coupler attached to a threaded portion of the pipe section;

(c) a stopper placed within said coupler, said stopper positioned to be actuated to allow an escape of gases from beneath the first plate through the hole; and (d) a second plate tack welded to a top of the surface casing of an abandoned well, wherein the stopper positioned into the coupler attached to the first plate is pushed against a lower surface of the second plate when actuated fully to allow the escape of gases from the well;

said well abandonment system obviating the need for valves.

9. The well abandonment system of claim 8, wherein the hole in the first plate has a diameter between 10 and 25 mm.

10. The well abandonment system of claim 8, wherein the threaded pipe is between 20 and 50 mm in length.

11. The well abandonment system of claim 8, wherein the threaded pipe is 25 mm in length.

12. The well abandonment system of claim 8, wherein the stopper comprises a rubber stopper.

13. The well abandonment system of claim 12, wherein the rubber stopper is #6.5 rubber stopper.

14. The well abandonment system of claim 8, wherein the first plate is located at a position operable to allow the stopper to eject partially from the coupler in response to gas pressure, wherein the stopper rests against the second plate of the cap of the surface casing.

15. A method of capping a hydrocarbon well consisting of:

(a) cutting a well casing string such that an internal production casing of the well casing string is cut lower than an external surface casing of the well casing string;

(b) inserting a first plate under a cut level of said surface casing and over a cut level of said production casing, said first plate having a hole with a threaded pipe therein, and a coupler section attached to said threaded pipe, and a stopper inserted into said coupler;

(c) welding said first plate to said surface casing to cover the production casing;

(d) welding a second plate to a top of the surface casing to provide a vented seal, such that said second plate rests above said stopper at a distance to only allow partial ejection of said stopper.

* * * * *